US006206360B1

(12) United States Patent
Urata et al.

(10) Patent No.: US 6,206,360 B1
(45) Date of Patent: Mar. 27, 2001

(54) PRINTER HAVING A PLURALITY OF PAPER CASSETTES AND METHOD OF SELECTING A PAPER CASSETTE FROM THE PAPER CASSETTES

(75) Inventors: Ichiro Urata; Kazuhiko Kasuya; Naoki Kanai, all of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/219,487

(22) Filed: Dec. 23, 1998

(30) Foreign Application Priority Data

Dec. 26, 1997 (JP) ..... 9-360309

(51) Int. Cl.[7] ..... B65H 3/44

(52) U.S. Cl. ..... 271/9.06; 271/3.15; 271/3.17; 271/8.01; 271/9.01; 271/9.05; 700/213

(58) Field of Search ..... 271/3.15, 3.17, 271/8.1, 9.01, 9.05, 9.06; 221/287; 700/213, 214, 217, 218, 219, 222, 223, 224, 225, 226

*Primary Examiner*—Donald P. Walsh
*Assistant Examiner*—Mark J. Beauchaine
(74) *Attorney, Agent, or Firm*—Rabin & Champagne, PC

(57) ABSTRACT

A printer includes a plurality of cassettes and a cassette is selected from the cassettes. The printer comprises a print information memory, paper information memory, cassette information memory, cassette selector, and data editor. The print information memory stores print information contained in print data therein. The print information includes a size of the print paper and an orientation of the print paper with respect to a direction of travel of the print paper. If a size of print paper specified by the print information is different from a size of print paper accommodated in a paper cassette selected last time, a first paper cassette is selected which accommodates print paper of a size specified by the print information. If the print information specifies print paper of a same size as the print paper accommodated in a paper cassette selected last time, a second paper cassette is selected which accommodates print paper oriented in a way different from the cassette selected last time.

8 Claims, 6 Drawing Sheets

FIG.4

23

| CASSETTES | SIZE OF PRINT PAPER | ORIENTATION OF PRINT PAPER |
|---|---|---|
| 2 | A4 | LENGTHWISE |
| 3 | A4 | WIDTHWISE |
| 4 | B4 | LENGTHWISE |
| 5 | B4 | WIDTHWISE |

PRINTER HAVING A PLURALITY OF PAPER CASSETTES AND METHOD OF SELECTING A PAPER CASSETTE FROM THE PAPER CASSETTES

BACKGROUND OF THE INVENTION

1. Field of the Invention

The present invention relates to a method of selecting a specified paper cassette from a plurality of paper cassettes, and further relates to a printer where a paper cassette specified by information contained in print data is selected from a plurality of cassettes and the print paper is fed from the selected paper cassette to a print engine.

2. Description of the Related Art

A conventional printer is constructed such that a plurality of paper cassettes are provided and print paper of a specified size is fed from a corresponding paper cassette in accordance with print information indicative of paper size. The printer is connected to a network so that many unspecified users can have access thereto.

In order for the users to easily pick out their print results, the paper stackers and paper-discharging mechanism of the printer are moved laterally on a job-to-job basis in order to sort stacks of print results.

The laterally movable discharge stacker and paper-discharging mechanism complicate printer operation and are further detrimental to reliable operation of the printer.

SUMMARY OF THE INVENTION

An object of the invention is to provide a printer such that printing results are efficiently sorted without using a complicated paper-discharging mechanism when the print results are discharged to the paper discharging stacker.

Another object of the invention is to provide a reliable printer of simple construction.

A printer according to the present invention is constructed such that pages of print paper are fed from a cassette selected from a plurality of paper cassettes. The printer comprises a print information memory, paper information memory, cassette information memory, cassette selector, and data editor. The print information memory stores print information contained in print data therein. The print information includes a size of the print paper. The paper information memory stores a size of the print paper and an orientation of the print paper accommodated in a selected paper cassette.

The cassette information memory stores a cassette selection table which lists paper cassettes and sizes of print paper and orientations of the print paper accommodated in the corresponding cassettes. The cassette selector compares the print information stored in the print information memory and the paper information stored in the paper information memory. If the print information and the paper information differ with regards to the size of print paper, then the cassette selector refers to the cassette selection table so as to select a first paper cassette that accommodates print paper of a size specified by the print information and of a predetermined orientation. Then, the cassette selector replaces the content of the paper information memory by the size and orientation of print paper accommodated in the first paper cassette.

If the print information memory and the paper information are the same with regards to the size of print paper, then the cassette selector refers to the cassette selection table so as to select a second paper cassette which accommodates print paper of a size stored in the paper information memory and of an orientation that is different from that stored in the paper information memory.

The data editor edits the print data in accordance with the size and orientation of print paper accommodated in the selected paper cassette.

A method is used to select a paper cassette from a plurality of paper cassettes accommodated in a printer in accordance with print information contained in print data. The method comprises the following steps. A cassette selection table is provided which lists paper cassettes and sizes and orientations of print paper accommodated in the cassettes. Then, if a size of print paper specified by the print information is different from a size of print paper accommodated in a paper cassette most recently selected, a first paper cassette is selected which accommodates print paper of a size specified by the print information. If the print information specifies print paper of a same size as print paper accommodated in a paper cassette most recently selected, a second paper cassette is selected which accommodates print paper oriented in a way different from the cassette selected last time.

Further, the scope of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 illustrates a cassette selection table;

DETAILED DESCRIPTION OF THE INVENTION

The invention will be described in detail with reference to the accompanying drawings.

Embodiment

Figure 1:
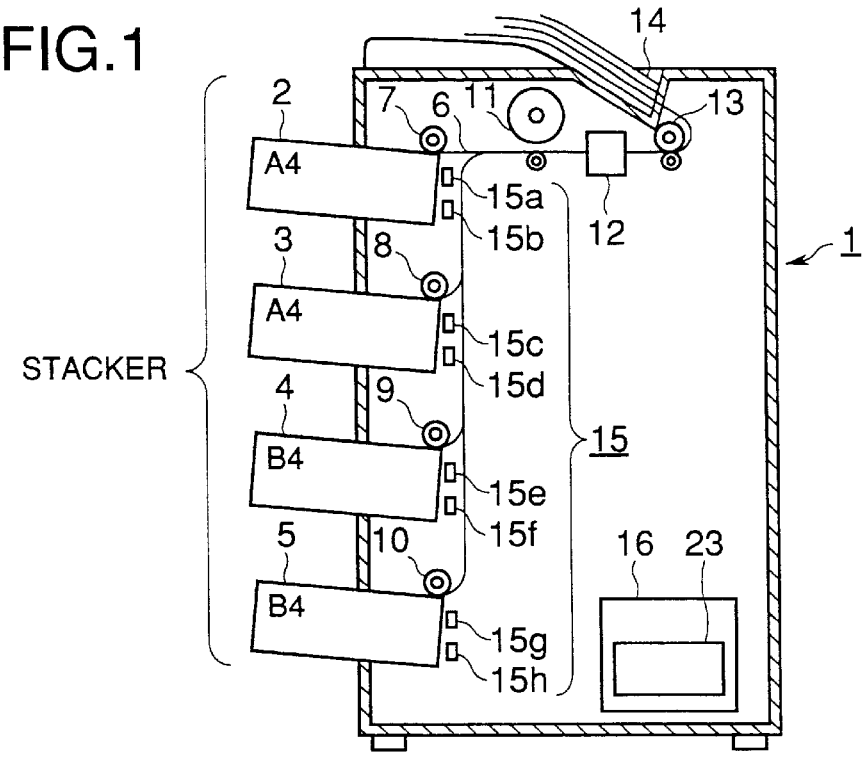
FIG. 1 is a sectional view of an elevation of a general configuration of a printer according to the present invention.

FIG. 1 illustrates a general construction of a printer according to the present invention.

A printer 1 includes a plurality of paper cassettes. The paper cassettes accommodate print paper of different sizes and orientations. The orientation is the direction of travel of the print paper when the print paper is fed from the paper cassette to the print engine. The cassettes are detachably inserted into the printer 1 and aligned vertically in the order of cassettes 2, 3, 4, and 5. The cassette 2 holds a stack of A4 (210 mm×296 mm) size paper that is oriented lengthwise. The cassette 3 holds a stack of A4 size paper that is oriented widthwise. The cassette 4 holds a stack of B4 size (257 mm×364 mm) paper that is oriented lengthwise. The cassette 5 holds a stack of B4 size paper that is oriented widthwise.

The printer incorporates feeding rollers 7–10 that feed the print paper from the cassettes 2–5 into a paper transport path 6. There are provided, for example, a feed roller 11, print engine 12, and discharge roller 13. The discharge roller 13 drives the print paper to travel to the discharge stacker 14 located on the top surface of the printer 1. The feeding rollers 7–10 are driven by a paper-feeding motor (not shown) which will be described later. The feed roller 11 and discharge roller 13 are driven by a paper-transporting motor 21 which will be described later.

Figure 2:
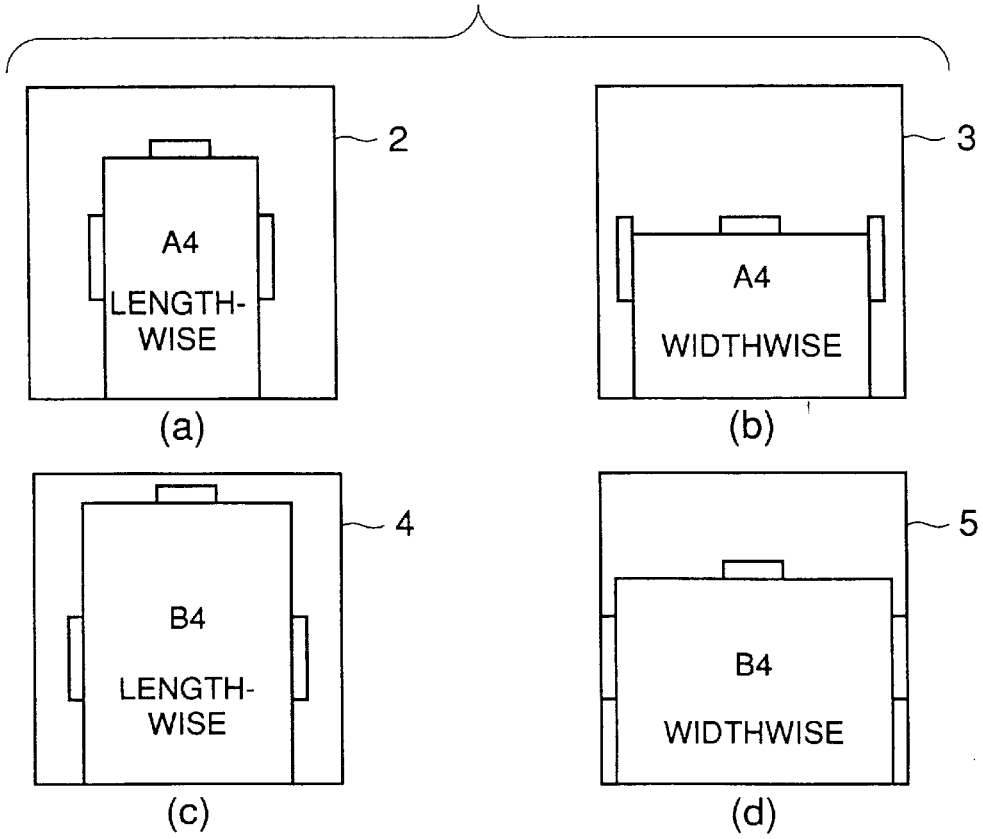
FIG. 2 is a plan view of the paper cassettes loaded into the printer of FIG. 1.

FIG. 2 illustrates the paper cassettes 2–5 that are loaded into the printer 1 shown in FIG. 1.

Sensors 15*a*–15*h* are provided to identify the cassettes 2–5 inserted into the printer 1. Since there are four different cassettes, two sensors are used in combination for identifying a cassette from the others.

The cassettes 3–5 are provided with corresponding projections, not shown, that cause the sensors to generate electrical signals that identify the cassettes 3–5. For example, when the cassette 2 is inserted, the light paths of the sensors 15*a* and 15*b* are not interrupted. When the cassette 3 is inserted, the projection of the cassette 3 interrupts the light path of the sensor 15*c*. When the cassette 4 is inserted, the projection of the cassette 4 interrupts the light path of the sensor 15*f*. When the cassette 5 is inserted, the projections of the cassette 5 interrupt the light paths of the sensors 15*g* and 15*h*. In this manner, the positions of respective cassettes 2–5 are expressed in terms of the outputs of the sensors 15*a*–15*h*.

Figure 3:
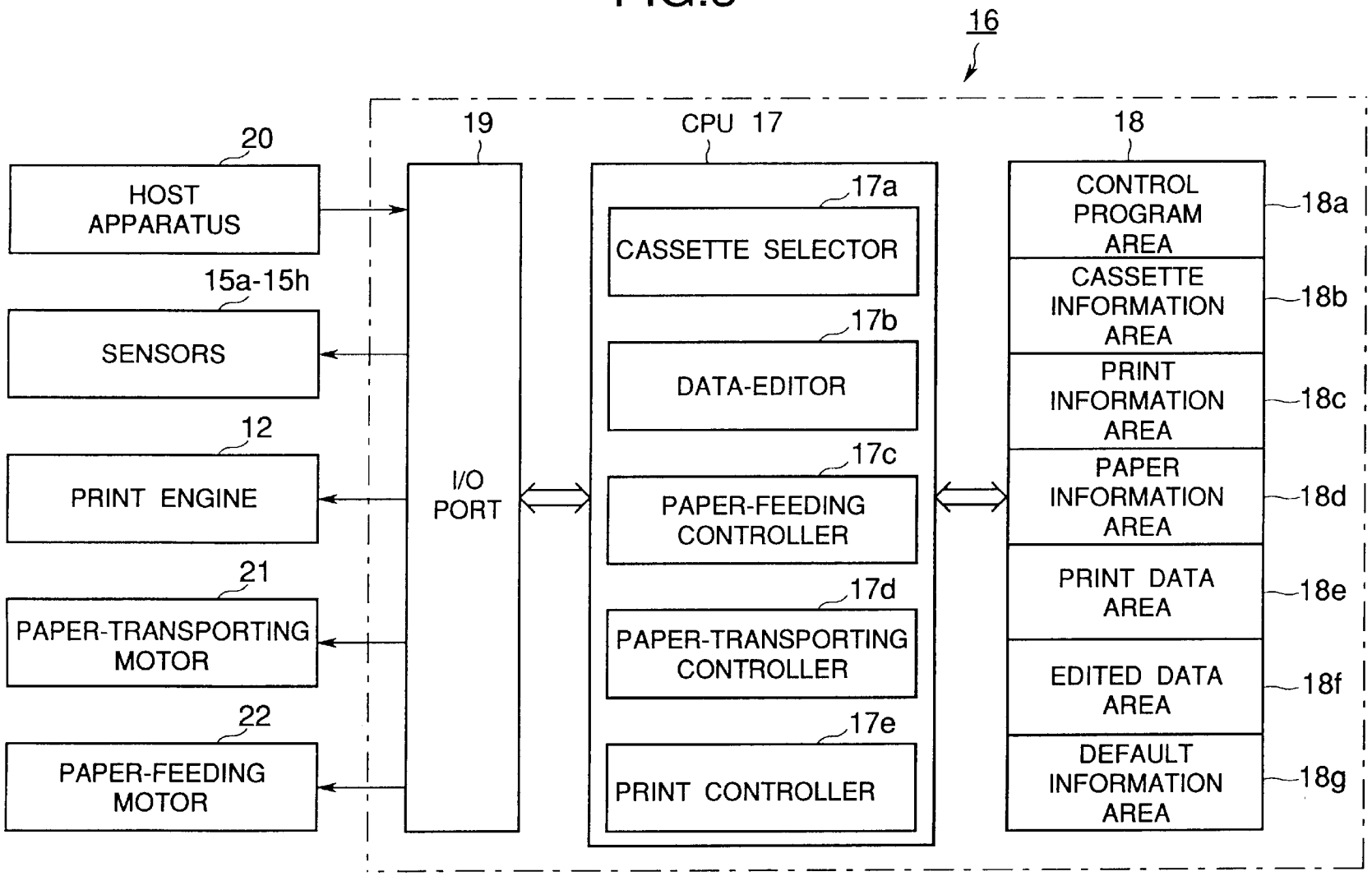
FIG. 3 is a control block diagram for the printer of FIG. 1.

FIG. 3 is a control block diagram for the printer of FIG. 1.

A controller 16 includes a central processing unit (referred to as CPU hereinafter) 17, memory 18, and input/output port (referred to as I/O port hereinafter) 19. The CPU 17 is connected via the I/O port 19 to a host apparatus 20, sensors 15, a print engine 12, a paper-transporting motor 21, and a paper-feeding motor 22. Only one host apparatus 20 is shown, by way of example, but a plurality of host apparatuses may be connected to the network since the network is designed to accommodate many unspecified users.

The memory 18 includes a control program area 18*a*, cassette information area 18*b*, print information area 18*c*, paper information area 18*d*, print data area 18*e*, edited data area 18*f*, and default information area 18*g*.

A control program is stored in the control program area 18*a*. The cassette information area 18*b* stores a cassette selection table 23 as shown in FIG. 4, the cassette selection table 23 listing the cassettes 2–5 and corresponding sizes of print paper and orientations of the print paper accommodated in the cassettes with respect to the direction of travel of the print paper.

The print information area 18*c* stores information on the size of print paper, the information being received from the host apparatus 20. The information received from the host apparatus 20 does not include the orientation of paper held in the paper cassette. The paper information area 18*d* stores information on the size and orientation of print paper accommodated in a selected paper cassette. The information stored in the paper information area 18*d* are retained until a size and an orientation of print paper that are different from the information stored in the paper information area 18*d* are specified. Thus, the content of the paper information area 18*d* is retained even though the current printing job has been completed. The edited data area 18*f* stores data which has been produced by editing the print data according to the size and orientation of print paper accommodated in the elected paper cassette. The default information area 18*g* stores default information which includes a predetermined orientation of the print paper with respect to the direction of travel of the print paper when the print paper is fed to the print engine.

Under the control of the control program stored in the control program area 18*a*, the CPU 17 operates as cassette selecting means 17*a*, data editing means 17*b*, paper feeding control means 17*c*, transport control means 17*d*, or print control means 17*e*, depending on the situation.

The paper cassette selection means 17*a* compares the size of print paper stored in the print information area 18*c* with that stored in the paper information area 18*d*. If the sizes of print paper are not the same, the cassette selection means 17*a* refers to the cassette selection table of the cassette information area 18*b* so as to select an appropriate paper cassette in which print paper of the size and orientation specified by the print information is accommodated. Since the information from the host apparatus 20 does not include the orientation of paper, a paper cassette having a default orientation of paper is selected. Then, the paper cassette selection means 17*a* replaces the content of the paper information area 18*d* by the size and orientation specified by the cassette selection table.

If the size of print paper stored in the print information area 18*c* and the size of print paper stored in the paper information area 18*d* are the same, the cassette selection means 17*a* refers to the cassette selection table that is stored in the cassette information area 18*b* so as to select a paper cassette in which print paper of a size specified by print information is accommodated with a different orientation from that in the paper information area 18*d*. Then, the cassette selection means 17*a* replaces the content of the paper information area 18*d* by the size and orientation of print paper accommodated in the selected paper cassette.

The data editing means 17*b* edits the print data received from the host apparatus 20 in accordance with the paper information area 18*d*. The paper feeding control means 17*c* drives the paper-feeding motor 22, the transport control means 17*d* drives the paper-transporting motor 21, and the print control 17*e* drives the print engine 12.

The operation of the printer will now be described with reference to FIGS. 5 and 7.

<First Mode of Control>

Figure 5:
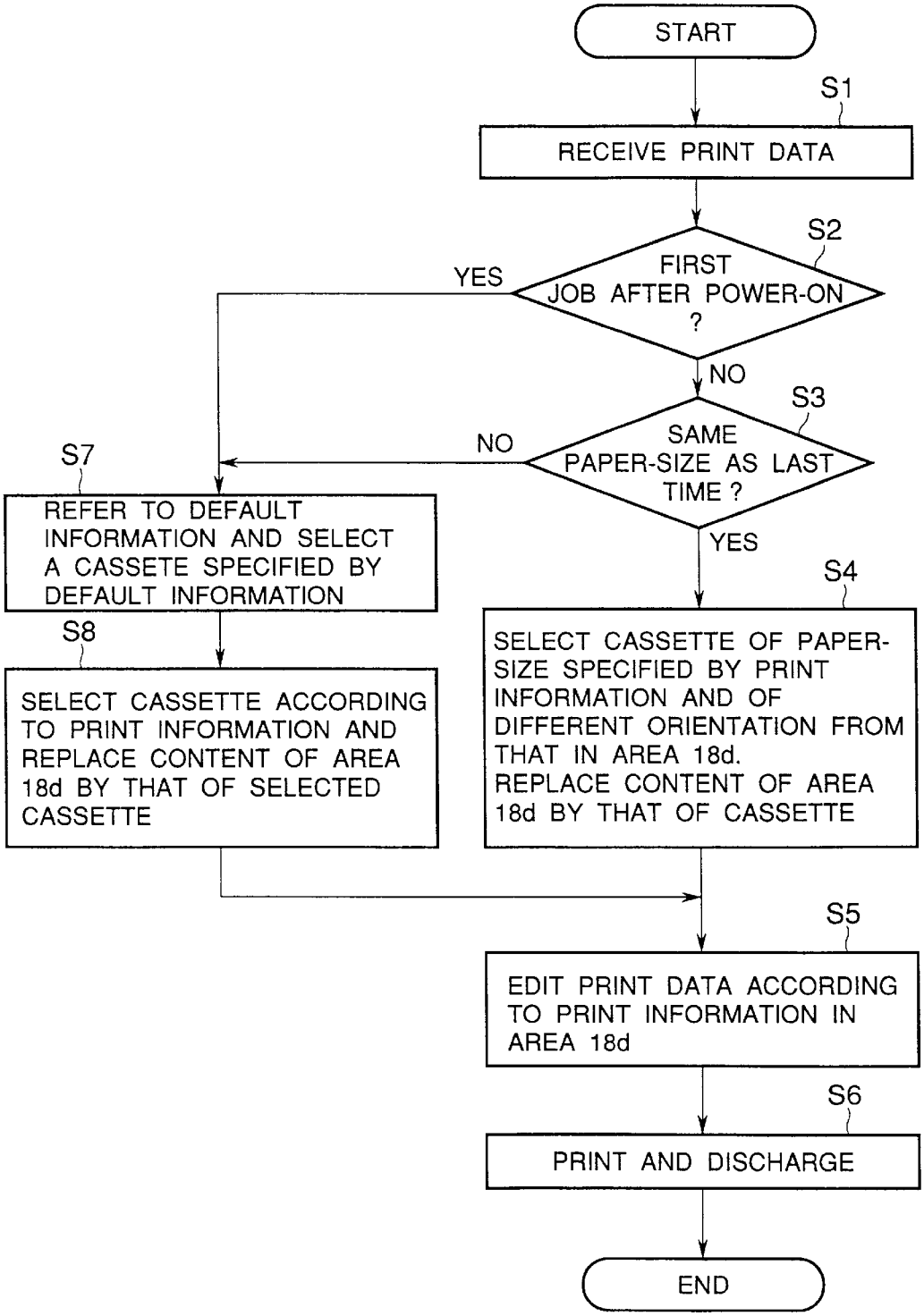
FIG. 5 is a flowchart illustrating the printing operation of the printer of FIG. 1.

FIG. 5 is a flowchart illustrating the printing operation according to a first mode of control. At step S1, the CPU 17 receives the print data from the host apparatus 20 and stores the print information contained in the header of the print data into the print information area 18*c* in the memory 18, the print information representing the size of print paper. At this step, the information stored in the paper information area 18*d* is the information regarding the size and orientation of the paper size that is stored in a cassette most recently selected.

At step S2, a check is made to determine whether a printing job is the first one after the printer is powered on. If YES, at step S2, then the program proceeds to step S7, and if NO, the program proceeds to step S3. At step S3, the CPU 17 compares information regarding the size of print paper stored in the print information area 18*c* with information regarding the size of print paper stored in the paper information area 18*d*, thereby determining whether a paper size currently specified by the print information is the same as that of the print paper accommodated in the cassette most recently selected. If the paper sizes are the same, then the program proceeds to step S4; if the paper sizes not the same, the program proceeds to step S7.

At step S4, the CPU 17 reads the cassette selection table 23 stored in the cassette information area 18*b* so as to select by way of sensors 15 an appropriate cassette from a plurality of cassettes, the cassette having the same paper size but having a different paper orientation from a paper cassette most recently selected. The CPU 17 also replaces the content of the paper information area 18*d* by the information on the size and orientation of print paper accommodated in the selected paper cassette.

At step S5, the CPU 17 edits the print data stored in the print data area 18*e* in accordance with the content of the print paper information area 18*d*. The CPU 17 stores the edited data into the edited data area 18*f*.

At step S6, the CPU 17 drives the paper-feeding motor 22 corresponding to the selected paper cassette, thereby feeding the print paper from the selected paper cassette. Then, the CPU 17 drives the paper transporting motor 21 and discharge roller 13 to transport the print paper to the print engine 12, so that the print paper is fed to the print engine 12 and then discharged to the discharge stacker 14. In this manner, the printing operation of one page is carried out.

At step S7, the CPU 17 refers to the default information to select a paper cassette that is holding print paper of a paper orientation (i.e., lengthwise or widthwise) specified by the default information. The default information represents a fixed predetermined orientation of paper irrespective of the paper size. Then, the program proceeds to step S8. At step S8, the CPU 17 refers to the cassette selection table 23 according to the content of the print information area 18*c*, thereby selecting a specified cassette by way of the sensors 15 from a plurality of cassettes, the selected cassette accommodating the paper of the size specified by the host apparatus 20. The CPU 17 also replaces the content of the paper information area 18*d* by the information regarding the size and orientation of the print paper accommodated in the selected cassette. Thereafter, the program proceeds to step S5.

Figure 6:
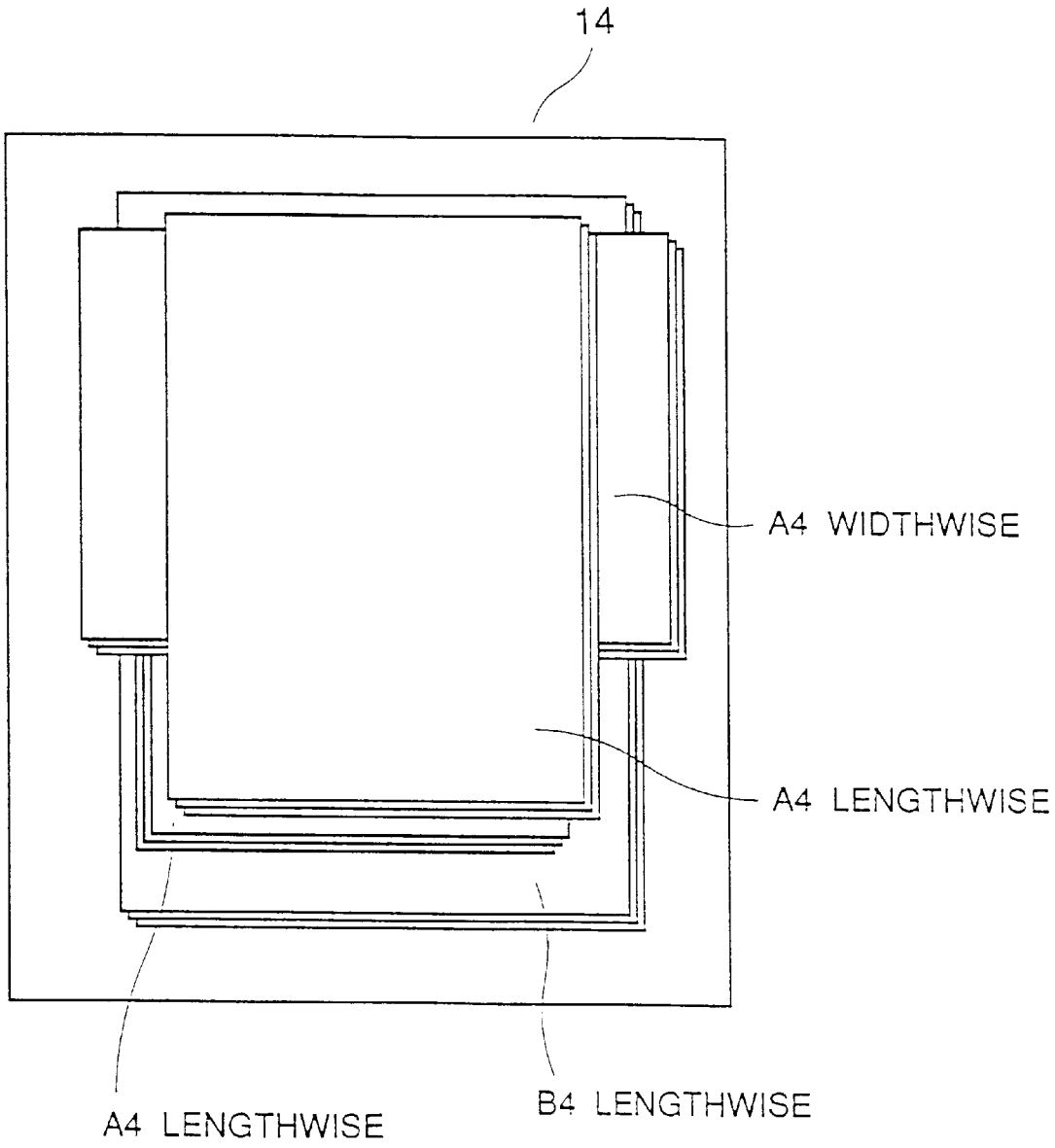
FIG. 6 is a top view of a paper stacker onto which a plurality of sets of pages are discharged one over the other.

For the first printing operation after power up of the printer, a cassette having print paper with a size specified by the host apparatus 20 is selected, and the information regarding the size and orientation of the print paper accommodated in the selected cassette is stored into the paper information area 18*d*. FIG. 6 is a top view of a paper stacker 14 onto which a plurality of sets or print jobs of pages are discharged one over the other.

The aforementioned flow of steps will be described more specifically with respect to an example of printing operation with reference to FIG. 6. By way of example, it is assumed that the host apparatus 20 specifies a printing operation of two copies of A4 size print paper oriented lengthwise, the paper cassette most recently selected accommodates a stack of B4 size print paper oriented lengthwise, and the default information is "lengthwise". The two copies of A4 size document may be two copies of a single document or a copy of each of two different documents. Each copy may be a single page or a plurality of pages. At step S3, since the print paper most recently printed is B4 size having a orientation lengthwise, it is determined that the currently specified paper size is not the same as that of print paper accommodated in the cassette most recently selected. Thus, the program proceeds to step S7. For the first copy, the CPU 17 refers to the cassette selection table 23 to select a cassette holding A4 size paper therein. Since the information from the host apparatus 20 does not include the orientation of paper, a paper cassette having a default orientation of paper (i.e., lengthwise) is selected at step S7. Then, at step S8, the CPU 17 replaces the content of the paper formation area 18*d* by the information regarding the size and orientation (i.e., size: A4, orientation: lengthwise) of the paper accommodated in the selected paper cassette.

At step S5, the CPU 17 edits the print data stored in the print data area 18*e* according to the content of the paper information area 18*d*. Then, the program proceeds to step S6 where the CPU 17 drives the paper feeding roller 7 for the cassette 2 in order to feed the A4 size print paper that is oriented lengthwise. Then, the CPU 17 drives the paper-transporting motor 21 and the discharge roller 13, thereby transporting the print paper to the print engine 12 for printing, and subsequently discharging the printed A4 size paper oriented lengthwise onto the previously discharged B4 paper oriented lengthwise.

For the second copy, the currently specified paper size is the same as that stored in the cassette selected last time (i.e., when the pages of first copy were printed). Thus, the program proceeds to step S4 where the CPU 17 reads the cassette selection table 23 to select the cassette 3 having A4 size print paper oriented widthwise, and replaces the content of the paper information area 18*d* by the information (i.e., size: A4, orientation: widthwise) on the print paper accommodated in the selected paper cassette. At step S5, the CPU edits the print data stored in the print data area 18*e* according to the content of the print paper information area 18*d*. At step S6, the CPU 17 drives the paper-feeding roller 8 for the paper cassette 3 in order to feed the A4 size print paper oriented lengthwise. Then, the CPU 17 drives the print paper-transporting motor 21 and the discharge roller 13, thereby feeding the print paper to the print engine 12 and then discharging the printed paper onto the preceding page of the A4 size paper oriented widthwise as shown in FIG. 6.

If another print job of, for example, A4 size is to be performed following the aforementioned two copies, the print job is carried out as follows: At step S4, the CPU 17 reads the cassette selection table 23 to select the cassette 2 having A4 size print paper oriented lengthwise, and replaces the content of the paper information area 18*d* by the information (i.e., size: A4, orientation: lengthwise) on the print paper accommodated in the selected paper cassette. At step S5, the CPU edits the print data stored in the print data area 18*e* according to the content of the print paper information area 18*d*. At step S6, the CPU 17 drives the paper-feeding motor 7 for the paper cassette 2 in order to feed the A4 size print paper oriented lengthwise. Then, the CPU 17 drives the print paper-transporting motor 21 and the discharge roller 13, thereby feeding the print paper to the print engine 12 and subsequently discharging the printed paper onto the preceding pages of the A4 size paper that is oriented widthwise as shown in FIG. 6.

<Second Mode of Control>

Figure 7:
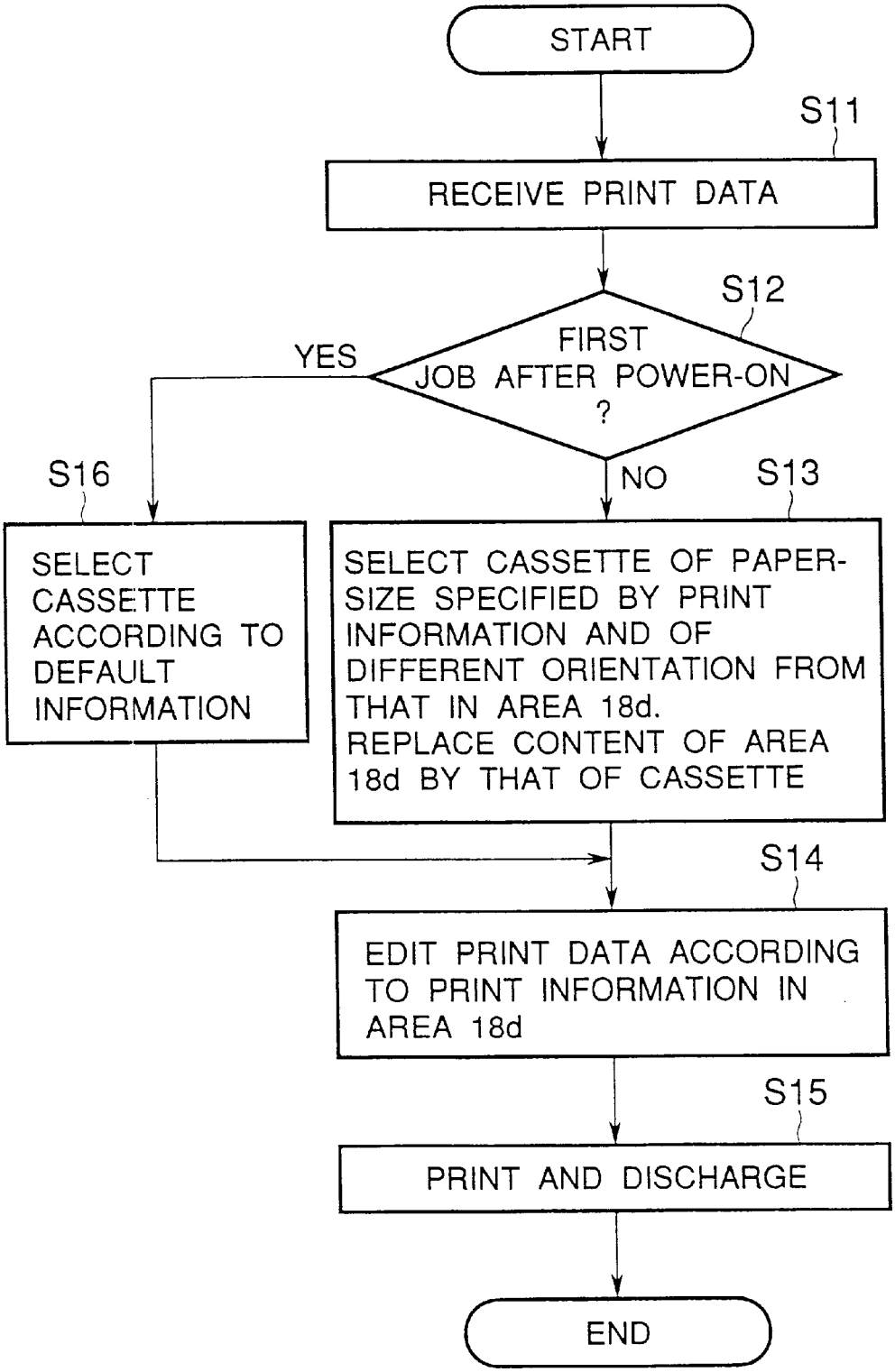
FIG. 7 illustrates a second mode of control.

FIG. 7 illustrates a second mode of control. The second mode of control differs from the first mode of control in that the orientation of the print paper is detected according to default information of the printer for the first print job after power-up, and thereafter the orientation is selected simply alternately with each other, for example, default (e.g., lengthwise)→widthwise→lengthwise→widthwise etc., irrespective of paper size.

Only steps that are different from the first mode will be described. If the answer is YES at step S12, then the program proceeds to step S16 where the CPU 17 selects a cassette according to the default information. The default information of the printer represents the orientation of print paper, for example, "lengthwise". If the answer is NO at step S12, the program proceeds to step S13 which is the same as step S4 of the first mode. At step S14,the CPU 17 edits the print data according to the print information that is stored in the printer information area 18*d*. At step S15, CPU 17 drives one of the paper feeding rollers 7–10, thereby feeding the print paper of an appropriate size. For the subsequent printing jobs, the orientation of print paper is selected simply alternately irrespective of the paper size.

The invention being thus described, it will be obvious that the same may be varied in many ways. Such variations are not to be regarded as a departure form the spirit and scope of the invention, and all such modifications as would be obvious to one skilled in the art intended to be included within the scope of the following claims.

What is claimed is:

1. A printer, wherein a page of print paper is fed from a paper cassette to a print engine, the paper cassette being selected from a plurality of paper cassettes, said printer comprising:

a print information memory that stores print information contained in print data, the print information representing a size of the print paper;

a paper information memory that stores paper information representing a size of the print paper and an orientation of the print paper accommodated in a selected paper cassette, the orientation being with respect to a direction in which the print paper is fed to the print engine;

a cassette selector that compares the print information stored in said print information memory and the paper information stored in said paper information memory, wherein, when the print information and the paper information coincide, said cassette selector selects a first paper cassette that accommodates print paper of the size stored in said paper information memory and of an orientation that is different from that stored in said paper information memory, and replaces the paper information in said paper information memory by the size and orientation of print paper accommodated in the first paper cassette; and a data editor that edits the print data in accordance with the size and orientation of the print paper accommodated in the first paper cassette.

2. The printer according to claim 1, further comprising a default information memory that stores default information, the default information including a predetermined orientation of print paper, wherein, when the print information is different in size of print paper from the paper information, said cassette selector selects a second paper cassette that accommodates print paper of the size specified by the print information and of the orientation included in the default information, and replaces the paper information in said paper information memory by the size and orientation of print paper accommodated in the second paper cassette.

3. The printer according to claim 2, further comprising a cassette information memory that stores a cassette selection table, the cassette selection table listing paper cassettes and sizes of print paper and orientations of the print paper accommodated in the corresponding cassettes, wherein said cassette selector refers to the cassette selection table when said cassette selector selects the second paper cassette.

4. The printer according to claim 1, wherein the predetermined orientation is lengthwise.

5. The printer according to claim 1, wherein the predetermined orientation is widthwise.

6. A printer, wherein a page of print paper is fed from a paper cassette to a print engine, the paper cassette being selected from a plurality of paper cassettes, said printer comprising:

a print information memory that stores print information contained in print data therein, the print information representing a size of the print paper;

a paper information memory that stores paper information representing a size of the print paper and an orientation of the print paper accommodated in a paper cassette most recently selected; and a cassette selector that selects a paper cassette accommodating print paper of a predetermined orientation when a printing job is a first printing job performed after the printer is powered on, and which selects a paper cassette accommodating print paper of an orientation different from that of the paper in the paper cassette most recently selected when at least one printing job has been performed after the printer is powered on.

7. A method of selecting a paper cassette from a plurality of paper cassettes accommodated in a printer in accordance with print information contained in print data, said method comprising the steps of:

selecting a predetermined orientation of print paper if the print information specifies a size of print paper that is different from a size of print paper accommodated in a paper cassette most recently selected, the orientation being with respect to a direction in which the print paper is fed from the cassette to a print engine;

selecting a first paper cassette which accommodates print paper of a size specified by the print information and of the predetermined orientation; and selecting a second paper cassette when the print information specifies print paper of a same size as the print paper accommodated in the paper cassette most recently selected, the second paper cassette accommodating print paper of an orientation that is different from that of the paper in the cassette selected.

8. The method according to claim 7, further including the step of selecting a cassette accommodating print paper of the predetermined orientation when a printing job is a first printing job performed after the printer is powered on.

* * * * *